United States Patent [19]

Rector

[11] 4,071,913

[45] Feb. 7, 1978

[54] PROTECTIVE GLOVES

[75] Inventor: Michael H. Rector, Santa Rosa, Calif.

[73] Assignee: Rector & Wolfe Incorporated, Santa Rosa, Calif.

[21] Appl. No.: 779,734

[22] Filed: Mar. 21, 1977

Related U.S. Application Data

[63] Continuation-in-part of Ser. No. 648,250, Jan. 13, 1976, abandoned.

[51] Int. Cl.[2] ..... A41D 13/10

[52] U.S. Cl. ..... 2/20; 2/161 A

[58] Field of Search ..... 2/159, 161 R, 161 A, 2/16, 20, 158

[56] References Cited

U.S. PATENT DOCUMENTS

| | | | |
|---|---|---|---|
| 425,887 | 4/1890 | Kohler | 2/20 X |
| 2,695,999 | 12/1954 | Arnold | 2/20 |
| 2,952,021 | 9/1960 | Finn | 2/20 |
| 3,031,680 | 5/1962 | Compiano | 2/161 A |
| 3,164,841 | 1/1965 | Buktoff | 2/161 R |
| 3,581,312 | 6/1971 | Nickels | 2/20 X |
| 3,606,614 | 9/1971 | Dimitroff | 2/159 |
| 3,643,386 | 2/1972 | Grzyll | 2/161 R X |
| 3,890,649 | 6/1975 | Diggins | 2/161 A |

*Primary Examiner*—Werner H. Schroeder
*Assistant Examiner*—Peter Nerbun
*Attorney, Agent, or Firm*—Melvin R. Stidham

[57] ABSTRACT

A protective glove, particularly for use in skateboarding, wherein the risk of falling is great. At the palm portion between a leather cover and an inner liner, is secured a thick resilient pad disposed to overlie the heel of the palm to absorb shock from impact, when one attempts to break his fall with extended hands. At the base of the glove is secured heavy elastic wrist band to protect against sprains as a result of such impact, and to co-act with the pad and glove leather in transferring and distributing impact forces from the palm pad and glove to the arm of the wearer.

3 Claims, 3 Drawing Figures

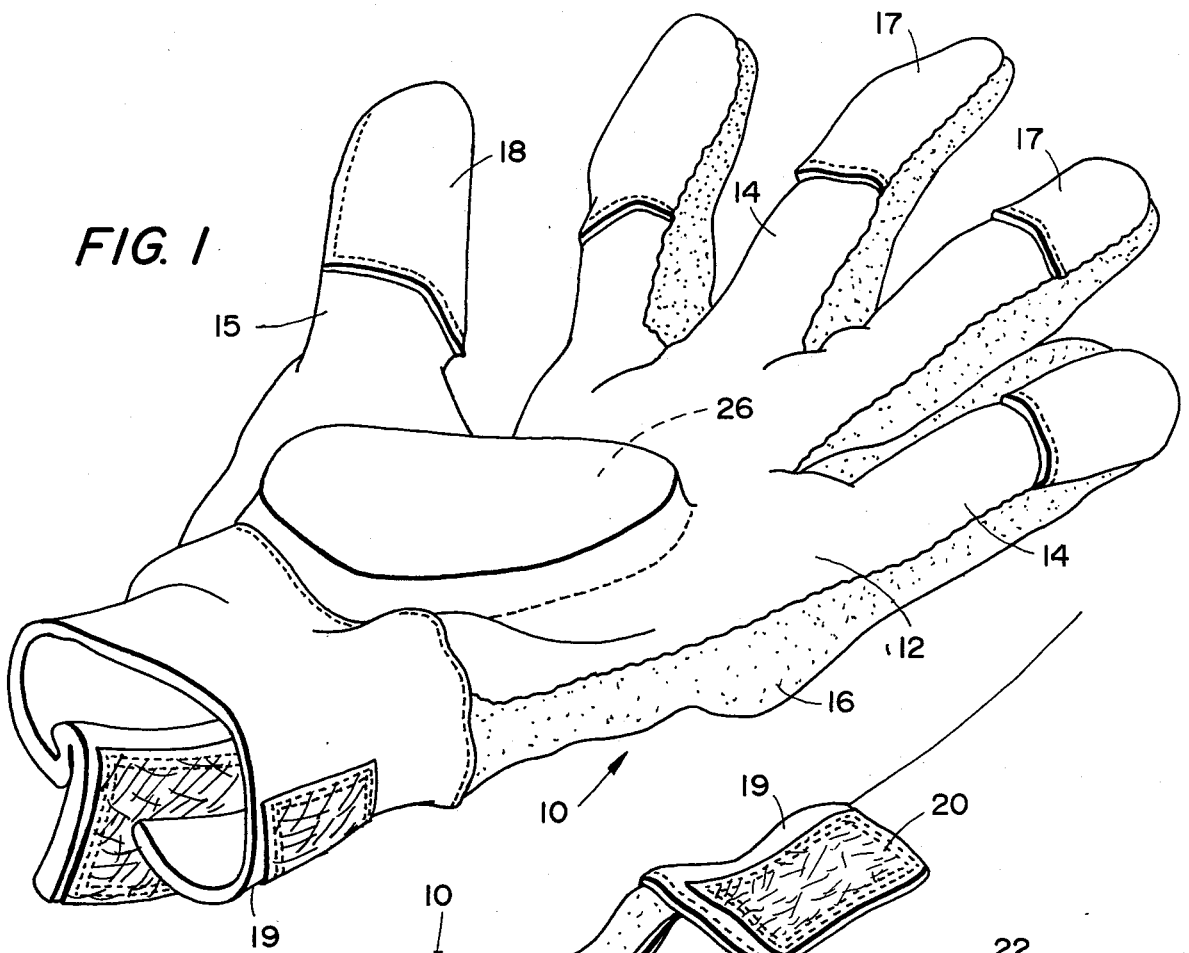
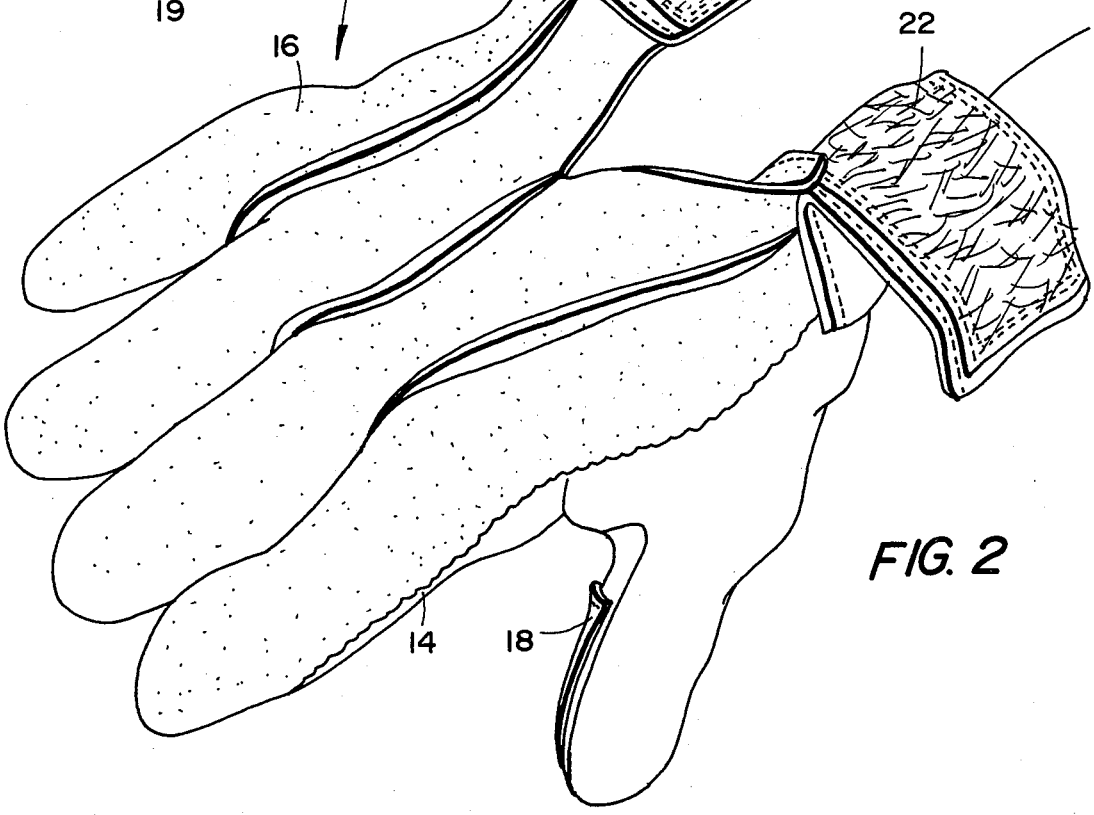
FIG. 2

PROTECTIVE GLOVES

RELATED APPLICATION

This application is a continuation-in-part of my copending application Ser. No. 648,250 filed Jan. 13, 1976 for "Protective Gloves" now abandoned.

BACKGROUND OF THE INVENTION

In skateboarding, an athletic activity which has gained considerable popularity in recent years, the risk of falling onto the hard surface over which one is traveling is considerable, and would produce serious injuries. The beginning skateboarder is taught, whenever possible to fall forward so that he may break his fall with his hands and avoid serious injury to elbows, shoulders or back. However, even if one is successful in so breaking his fall, there is still the possibility of abrasion or even more painful injury to one's hands, and particularly to the heel of the palm, as well as the possibility of wrist strain or sprain.

OBJECTS OF THE INVENTION

It is an object of this invention to provide a protective glove for one using his hands to break a fall for protection against skin abrasions.

It is a further object of this invention to provide a protective glove for activities wherein the possibility of falling are great, having means to protect the heel of the palm against impact.

It is a further object of this invention to provide a protective glove for activities wherein the risk of falling is great, having means to transfer and distribute impact forces over the palm and arm unitized by the glove.

Other objects and advantages of this invention will become apparent from the description to follow when read in conjunction with the accompanying drawing.

BRIEF SUMMARY OF THE INVENTION

In carrying out this invention, I provide a protective glove, preferably made of a tough material, such as leather, to protect against skin abrasions. The glove may be at least partially lined, and secured between the liner and the leather covering the palm, particularly including the heel of the palm, is a thick resilient pad of dense foam rubber or the like. Secured along the lower edge of the glove is a wrist band of heavy support elastic and of a sufficient length to wrap and be secured firmly around the wrist, and particularly, to hold the glove firmly in place pulled toward the back of the wrist. Hence, the glove provides protection against abrasion and particularly against painful injury to the heel of the palm and/or to the wrist. Moreover, the attachment of the heavy support elastic to the leather of the glove pulling the glove firmly enables the glove leather to transmit impact forces and diffuse them throughout the resilient pad and, through the elastic wrist band, to the arm.

BRIEF DESCRIPTION OF THE DRAWING

Referring now to the drawings:

FIG. 1 is a front view in perspective showing a glove embodying features of this invention;

FIG. 2 is a back view in perspective of the glove; and

DESCRIPTION OF A PREFERRED EMBODIMENT

Figure 3:
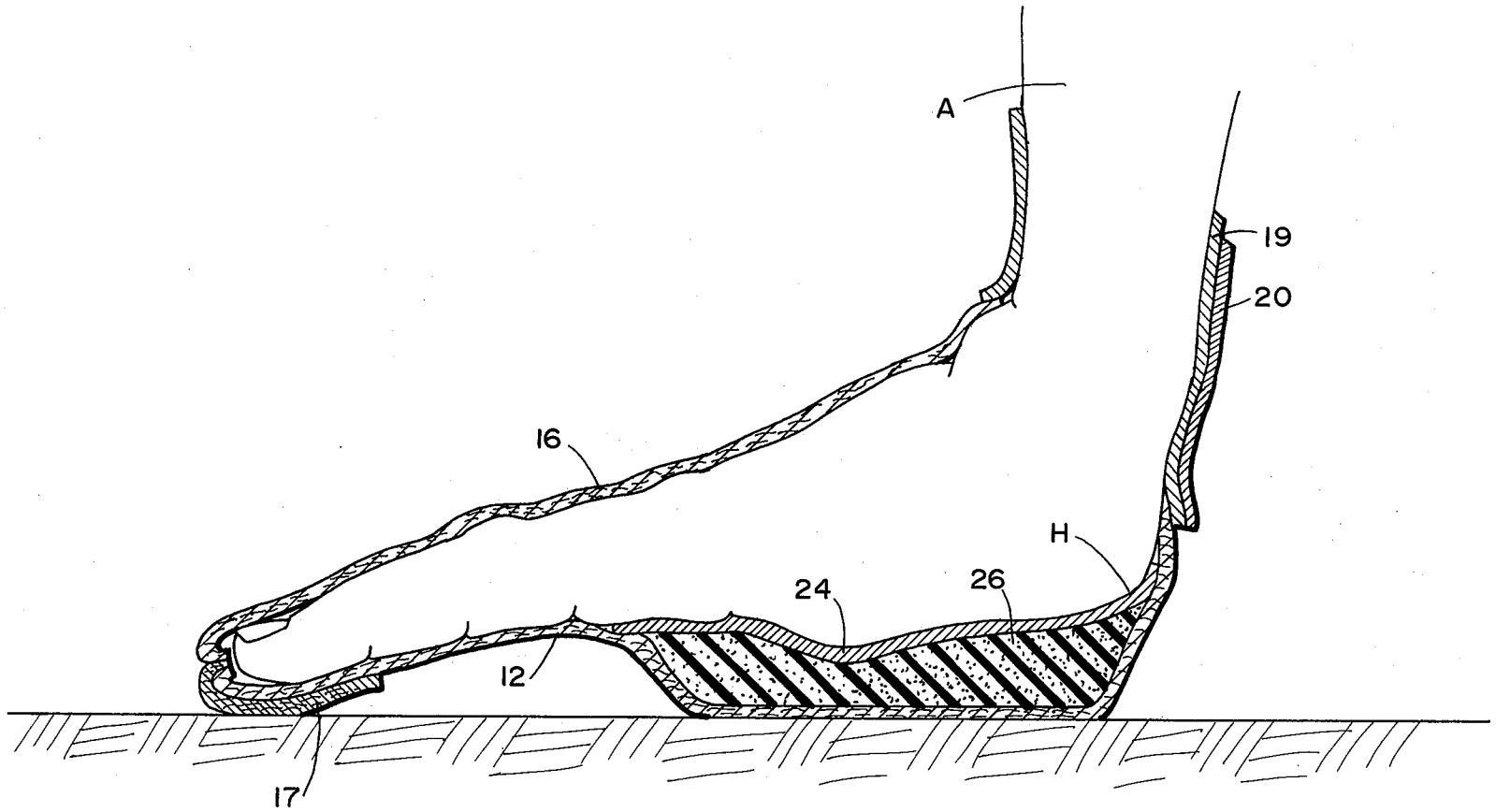
FIG. 3 is a section view of the glove and human hand showing its inner construction, and illustrating protection against impact.

Referring now to the drawings with greater particularity, the glove 10 of this invention comprises a plam or front body portion 12 having formed integrally therewith finger and thumb receptacles 14 and 15 which receive and cover the fingers and thumbs of the wearer. The front body portion 12 and fingers 14 are preferably made of a tough wear and tear resistant material such as pigskin or other suitable leather to withstand scrapes with concrete and other hard, abrasive surfaces while protecting the hands. The front body portion 12 covers the entire palm of the wearer extending to below the heel H thereof (FIG. 3) for maximum protection, and the back body portion 16 may be of a softer, more pliant material, such as suede, for comfort. As additional protection to the wearer, I provide extra layers of protective leather 17 and 18 on the ends of the fingers 14 and thumbs 15.

Secured along the base or lower edge of the glove body 12, is a wrist band 19 made of heavy support elastic or the like, and of sufficient length to wrap completely around the wearer's wrist. The wrist band 19 is provided with suitable fastening means 20, 22 such as the adjustable gripping means sold under the trademark "VELCRO", whereby the band may be secured as snugly as possible around the wrist to afford maximum protection against sprains and to retain the glove firmly in place for reasons to be described.

A partial liner 24 (FIG. 3) is stitched or otherwise secured to the inside of the palm portion of the glove 10 and such liner may be of the same leather material and substantially the same extent as that of the outer palm 12. Retained between the partial liner 24 and the leather exterior 12 is a thick, resilient, impact pad 26 of dense foam rubber or the like which extends over much of the palm, and particularly extends down as close as possible to the wristband 18 so that it will overlie the heel of the palm, which is particularly susceptible to painful injury from impact. The leather of the palm portion 12, pulled tight by the wristband with the pad 26 pressed against the palm, provides a structural continuity between the resilient impact pad 26 and the wristband 19 to transfer and distribute impact forces over the pad, as well as over the hand of the wearer.

In use, the skateboarder is taught to maintain positions which would enable him to fall forward in the event that a fall became inevitable. Then, with the hand used as a cushion to break the fall, the leather palm portion 12 protects the palm; knuckles and finger joints against abrasions; the thick pad 26 absorbs the impact to protect the vulnerable heel of the palm; the heavy wristband 18 protects the wrist against sprain; and the pad, glove leather and wristband pulled tightly in place cooperate to hold the hand and wrist against distortion on impact and to transfer and distribute impact forces from the pad to and over the hand and arm.

While this invention has been described in conjunction with a preferred embodiment thereof, it is obvious that some modifications and changes therein may be made by those skilled in the art without departing from the spirit and scope of this invention, as defined by the claims appended hereto.

What I claim as my invention is:

1. A protective glove for wear in skateboard activities and the like wherein the risk of falling on hard surfaces is great, comprising:

a front body portion for covering the palms and sides of the hand:

said front body portion being of a wear and tear resistant material and terminating in a lower edge thereof to be disposed below the heel of the palm of the hand;

a thick, impact-absorbing resilient pad secured inside said front body portion to cover a substantial part of the palm including said heel thereof;

a liner of flexible material fully covering said pad and surrounding portion of the inner surface of said body portion and being secured around its outer portions to said inner surface;

a back body portion for covering the back hand of a soft pliant material;

a wide heavy elastic wristband secured along said lower edge to encircle and fully cover the wrist joint; and means for securing the ends of said wristband together in overlapping relationship to hold said glove front body portion pulled tightly toward the back of the wrist with the pad pressed against the palm so that impact forces are distributed through said pad and body portions to said wristband.

2. The protective glove defined by claim 1 including:

finger receptacles on said body portions for receiving and covering the fingers and thumbs; and fingertip protective layers on the outside fronts of said finger receptacles.

3. The protective glove defined by claim 1 wherein:

said front body portion is of a tough leather.

* * * * *